US005104725A

United States Patent [19]

Broaddus, deceased

[11] Patent Number: 5,104,725

[45] Date of Patent: Apr. 14, 1992

[54] BATTS AND ARTICLES OF NEW POLYESTER FIBERFILL

[75] Inventor: Clarke R. Broaddus, deceased, late of Greenville, N.C., by Helen Ruff Broadus, executrix

[73] Assignee: E. I. DuPont de Nemours and Company, Wilmington, Del.

[21] Appl. No.: 516,937

[22] Filed: Apr. 30, 1990

Related U.S. Application Data

[63] Continuation-in-part of Ser. No. 334,832, Apr. 7, 1989, which is a continuation-in-part of Ser. No. 120,438, Nov. 13, 1987, abandoned, which is a continuation-in-part of Ser. No. 225,807, Jul. 29, 1988, Pat. No. 4,836,763.

[51] Int. Cl.[5] ..... A47C 27/00; D02G 3/00

[52] U.S. Cl. ..... 428/224; 5/448; 5/482; 428/357; 428/362; 428/369; 428/376; 428/395; 428/398

[58] Field of Search ..... 428/224, 357, 369, 398, 428/362, 376, 395; 5/434, 448, 482

[56] References Cited

U.S. PATENT DOCUMENTS

| | | | |
|---|---|---|---|
| 3,745,061 | 7/1973 | Champaneria | 428/398 |
| 3,772,137 | 11/1973 | Tolliver | 428/369 |
| 4,020,229 | 4/1977 | Cox, Jr. | 428/398 |
| 4,129,675 | 12/1978 | Scott | 428/398 |
| 4,520,066 | 5/1985 | Athey | 428/362 X |

FOREIGN PATENT DOCUMENTS 3011118 10/1981 Fed. Rep. of Germany .

*Primary Examiner*—Lorraine T. Kendell

[57] ABSTRACT

Batts and filled articles of polyester fiberfill of round peripheral cross-section, but containing voids arranged peripherally around an axial void, and preferably seven such voids in a hexagonal packing arrangement.

48 Claims, 2 Drawing Sheets

10 μ

10 μ

BATTS AND ARTICLES OF NEW POLYESTER FIBERFILL

CROSS REFERENCE TO RELATED APPLICATION

This application is a continuation-in-part of my earlier application, Ser. No. 07/334,832, filed Apr. 7, 1989, which is itself a continuation-in-part of my earlier applications, Ser. No. 07/120,438, filed Nov. 13, 1987, now abandoned, and Ser. No. 07/225,807, filed July 29, 1988, issued as U.S. Pat. No. 4,836,763 on June 6, 1989.

TECHNICAL FIELD

This invention concerns batts and articles of new polyester fiberfill, i.e., crimped polyester fiber, of suitable denier and otherwise suitable for use as filling material, containing multiple continuous voids along the length of the filaments, and processes for its preparation and its use.

BACKGROUND OF THE INVENTION

Polyester fiberfill (sometimes referred to as polyester fiberfilling material) has become well accepted as a reasonably inexpensive filling and/or insulating material for pillows, cushions and other furnishing materials, including bedding materials, and in apparel, because of its bulk, filling power, aesthetic qualities and various advantages over other filling materials, so is now manufactured and used in large quantities commercially. Crimp is a very important characteristic. Crimp provides the bulk that is an essential requirement for fiberfill. Slickeners, referred to in the art and hereinafter, are preferably applied to improve aesthetics. As with any product, it is preferred that the desirable properties not deteriorate during prolonged use; this is referred to generally as durability. In the case of fiberfill, a very desirable property is the ability to recover from compression, so as to provide the desired aesthetics after repeated and/or prolonged compressions, and provide the desired degree of softness (or firmness) again and again when recompressed. Although this has been desirable, little has been published on fiberfill properties that provide durability.

Originally, as with other polyester fibers, solid fibers of round cross-section were used, being the least expensive fibers to make, and such solid round polyester fiberfill is still used commercially. Some twenty years ago, however, hollow polyester fiberfill was suggested and used, as disclosed, e.g., by Tolliver in U.S. Pat. No. 3,772,137 and by Glanzstoff in GB Patent No. 1,168,759. Tolliver shows a single hollow core, i.e., a central continuous longitudinal void. The preferred shape of the void was non-round in cross-section, but voids approximately circular in cross-section were also disclosed, and large quantities of hollow polyester fiberfill having single central voids of circular and of non-round cross-section have been manufactured and used because of their greater lightness (lower density), in contrast to solid fiberfill, and because of the improvement in insulating power, and for other aesthetic reasons. More recently, there has been provided an improved hollow polyester fiberfill, characterized by four equisized, equispaced, non-round voids around a solid axial core, the filament cross-section having a quadrilateral peripheral contour defined by four flattened sides and four rounded corners, in conjunction with a saw-toothed type of crimp configuration and a slickening agent, to provide high bulk and high bulk durability with improved softness more like that of natural down filling, as disclosed in EPA2 67,684. Thus, this 4-hole cross-section has been believed superior in various respects, including bulk durability.

In the course of my considerations of how to make further improvements in fiberfill, and of my analysis of existing forms of fiberfill, I considered the possibility that important advantages could perhaps be obtained by making further changes in the cross-sectional shape of hollow filaments. However, as is well known, it is difficult to melt-spin filaments with multiple voids (especially from polyester) so it became necessary for me to design an entirely new spinneret, with new orifices, in order to spin hollow filaments according to the present invention. This new spinneret is the subject of my application, Ser. No. 07/225,807, now U.S. Pat. No. 4,836,763.

SUMMARY OF THE INVENTION

Thus, despite the improvements that have been available for several years from the various existing configurations that have been suggested and used commercially for polyester fiberfill having continuous longitudinal voids, my new improved polyester fiberfill, according to the present invention, provides further and surprising advantages in contrast with each of these specific prior configurations, considered separately.

According to my invention, there are provided batts and filled furnishing or apparel articles of polyester fiberfill, being of crimped polyester fiber of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament. According to one embodiment, all voids are preferably of essentially the same size and essentially equally spaced from adjacent voids, and so constitute exactly 7 in number, in a hexagonal packing arrangement with a central void and 6 outer voids at the points of a hexagon, as will be particularly illustrated and discussed hereinafter.

It is also contemplated, however, that the central void may be somewhat larger in cross-section than the outer voids, which latter are substantially equisized and equispaced from each other, and are also equally spaced from the periphery of the central void, so as to provide the advantages of a larger central void; according to this embodiment, the outer voids are preferably symmetrically arranged and constitute an even number, especially 8, making a total of 9 voids with the central void.

The preferred total void content will generally be about 8 to about 25%. Void contents in this field are by area, measured on the cross-section of the polyester filaments, on an averaged basis, as is known in the art.

As discussed, the provision of crimp in polyester fiberfill is extremely important in providing bulk, or loft, and with regard to its durability. An important advantage, according to the invention, is the improvement in durability that is achieved. The crimp frequency is preferably about 4 to about 12 crimps per inch, corresponding approximately to about 1.5 to about 5 crimps per cm, and preferably about 4 to about 9 crimps per inch, corresponding approximately to about 1.5 to about 3.5 crimps per cm.

The fiberfill is preferably slickened with a durable slickener.

Preferably, the polyester fiberfill is of cut fiber, often referred to as staple, of length from about half an inch to about four inches. As indicated, the denier is rather larger than for most apparel purposes. This is because the requirements and objective of fiberfill are entirely different from those for making yarns, e.g., for weaving or knitting.

According to my invention, there are also provided processes for preparing such new polyester fiberfill and precursor filaments, as described herein, and for preparing the batts and filled furnishing and apparel articles that are filled with such new polyester fiberfill, including such articles filled with such new polyester fiberfill alone or blended with other filling materials.

DETAILED DESCRIPTION OF THE INVENTION

I believe that the number and arrangement of the multiple continuous voids that extend along the length of the round filaments contribute importantly to improvements over those that have been suggested or used for polyester fiberfill hitherto. One can speculate that some, at least, of the advantages can be explained, in retrospect, by analogy with and comparison with prior art configurations/cross-sections, but my combination of elements is believed new, insofar as polyester fiberfill is concerned. I believe the round periphery is very important. I believe that the location of a void centrally, i.e., axially, is important; polyester fiberfill according to the invention has this feature in common with the earlier suggestion by Tolliver; polyester fiberfill of my invention is, however, distinguished from Tolliver's configuration by the provision of multiple essentially parallel voids, whereas Tolliver provided only a single void. In contrast, EPA2 67,684 provided multiple essentially parallel voids (4 in number), and thereby derived certain improvements in comparison with the polyester fiberfill of Tolliver, containing only a single axially-located void; the polyester fiberfill of EPA2 67,684 is distinguished in several respects, namely being of essentially quadrilateral peripheral cross-section, having a solid axial core and only 4 continuous parallel voids that are themselves non-round and only in the corners, or lobes, of the quadrilateral; as will be noted hereinafter, the polyester fiberfill of my invention makes possible an improvement in crimp configuration and durability that I believe is more difficult, and possibly even impractical to achieve with this prior art polyester fiberfill.

Figure 3:
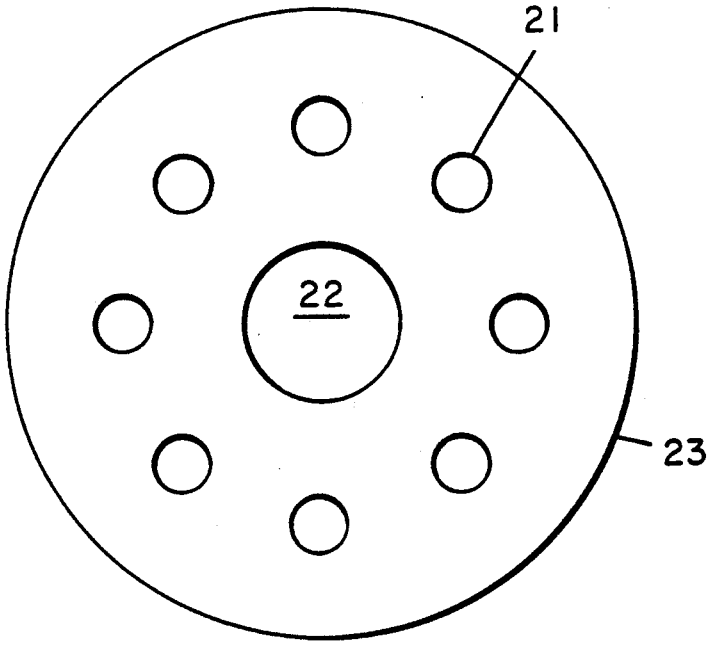
FIG. 3 is a representation of a cross-section of another embodiment of the invention.

Although my invention is not limited by any theory of operation, or any speculated rationalization, in view of the many factors involved and a still imperfect understanding of the reasons for the improvements, I have speculated that the multiple voids with one central void of the configuration of the present invention may provide better crush resistance, in the sense of permitting a higher stiffness for the same void content, and I have further speculated that, after crimping, the crimp configuration may provide more rounded corners, as opposed to a more saw-toothed or sharp cornered crimp configuration such as may result from crimping prior configurations for polyester fiberfill having similar void content, and this (in association with the round peripheral cross-section) may account for better frictional properties and for greater durability during use. I have also speculated that this is confirmed by the generally better crimp take-up that I have noted, which improvement, in my opinion, may correlate with better performance, as filling material, and better springiness. This could be especially true for the configuration shown in FIG. 1, involving exactly 7 voids, that are equisized and equispaced from adjacent voids, in other words in a hexagonal packing arrangement, since I believe this to provide an optimum structure in this regard, being symmetrical, and presenting an optimum strength to weight (in the sense of lightness) relationship. However, for some applications, it may prove preferable to increase the size of the central void (in relation to the outer voids), and thereby derive some of the advantages of the large central void suggested by Tolliver, in association with a multi-void structure; in this regard, I believe that a symmetrical arrangement provides advantages; in other words, e.g., as shown in FIG. 3, 8 equispaced outer voids 21 arranged around and equally spaced from a larger central void 22, making a total of 9 essentially parallel voids in a filament of essentially round peripheral cross-section 23, may provide certain advantages, it being understood that other arrangements of multiple voids around a central void are possible, but will generally provide less symmetry than a hexagonal-packing arrangement.

In principle, the technology for melt-spinning hollow filaments from polyester and other synthetic polymers has long been known and disclosed in the art. H. Bohringer and F. Bolland presented a paper entitled "Development and Evaluation of Profiled Synthetic Fibers With and Without Hollow Core", Faserforschung und Textiltechnik 9, No. 10 (October, 1958) pages 405–416, and referred to several other publications therein. This publication was primarily addressed to providing nylon filaments, for use in making textile fabrics, e.g. by knitting, as opposed to polyester fiberfill for use as filling material. Although several multi-hole filaments are shown, with spinneret designs for obtaining such multi-hole filaments, this publication did not disclose any way to spin polyester into a configuration according to the present invention with a central void having a total of at least 7 voids, all round, in an essentially round filament. Indeed, I am not aware of any previous design of a spinneret capable of solving this problem of spinning such a polyester filament, and I found this problem of spinneret design required much skill and effort to solve. So, considerable difficulty and extensive experimentation were necessary to design a suitable spinneret, and it had been doubted by some that the task could be achieved in practice because, e.g., of the problem of making a central void within a ring of outer voids in such fine filaments, with even smaller voids, and achieving round voids, and a round periphery, and the well-known phenomenon of post-orifice bulging and because of the difficulty known as "kneeing". Nevertheless, this task was achieved as described in my application, Ser. No 07/225,807, now U.S. Pat. No. 4,836,763, the contents of which are hereby incorporated by reference.

Such spinnerets comprise a plate having upper and lower surfaces connected by a capillary. The capillary is formed of a plurality of segments. Each segment is comprised of an outer and an inner arcuate slot joined by a rectangularly shaped slot that places the arcuate slots in communication with each other. The segments are equally spaced a distance from the center of the capillary and are equally spaced angularly about the center of the capillary. In a preferred embodiment, the slot joining the inner and outer arcuate slots joins them at a central location and has a width that is greater than the width of the inner arcuate slot, and the outer arcuate slot has a width greater than the width of the slot joining the inner and outer arcuate slots. The spinneret is a one piece spinneret which does not suffer the disadvantages of multi-part spinnerets which are adapted to form hollow fibers, and is adapted to be mounted in a filter pack for supplying polymer to be spun into filaments.

Figure 1:
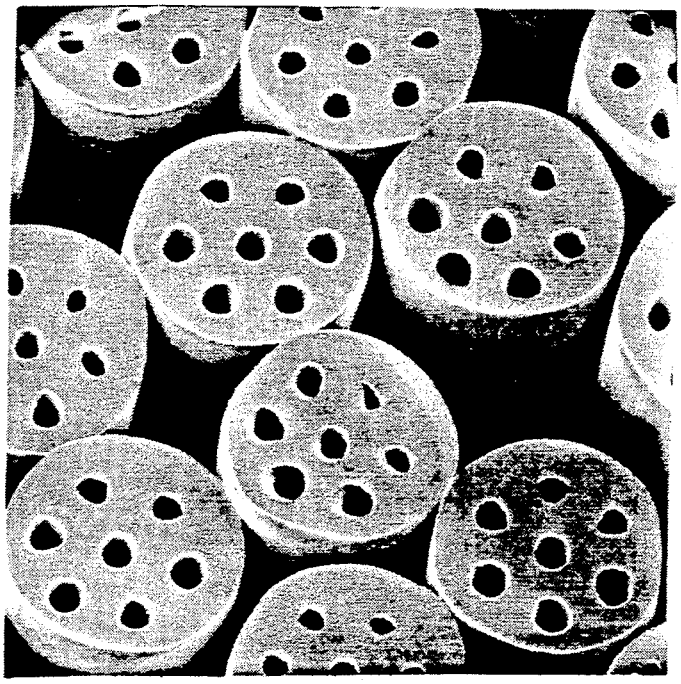
FIG. 1 is a photomicrograph of cross-sections of typical polyester fiberfill filaments according to one embodiment of the present invention.
Figure 2:
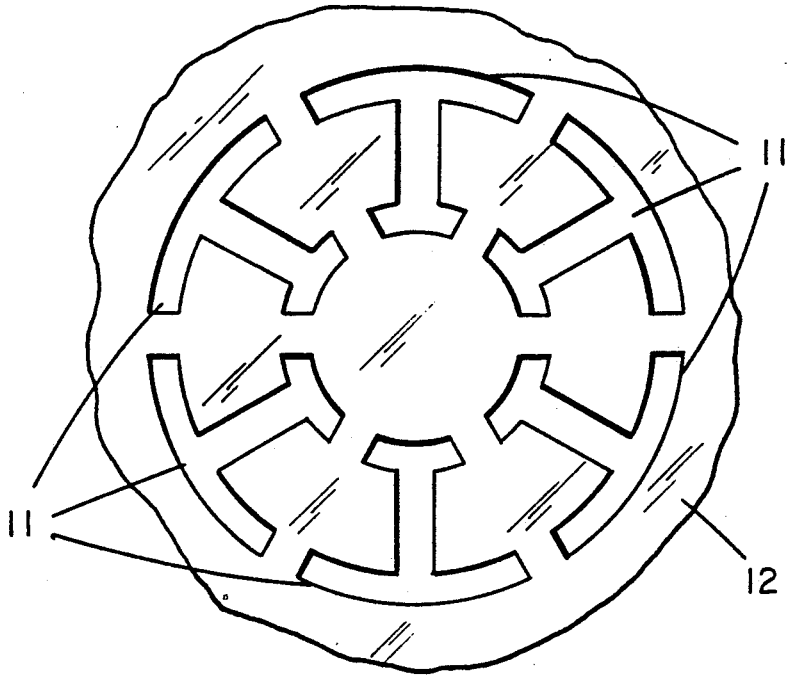
FIG. 2 is an enlarged view of a spinneret orifice suitable for melt-spinning polyester fiberfill filaments as shown in FIG. 1.

A preferred spinneret orifice design is shown in FIG. 2, herein, in which six orifices 11 are arranged (in the surface 12 of the spinneret) so that polymer will be extruded through each orifice, and will then coalesce to form a round filament, with 7 voids that are essentially equi-sized and equi-spaced, as shown in FIG. 1. The spinneret is formed from a plate and is provided with a plurality of capillaries connecting its upper and lower surfaces respectively. Each capillary is formed of six individual segments. Each segment is spaced an equal distance from the center of the capillary and also the segments are equispaced from each other angularly about the center. Each segment has the same dimensions and includes an outer arcuate slot connected to an inner arcuate slot by an elongated slot located between and in communication with the inner and outer arcuate slots.

In the preferred configuration of the capillary, the width of the connecting slot is greater than the width of the inner arcuate slot and the width of the outer arcuate slot is greater than the width of the connecting slot.

A typical capillary has an outside diameter of 0.062 inch, an inside diameter of 0.024 inch, the angular spacing is about 60°, and the relationship of the slot widths is about as follows: outer arcuate slot width 1.2: connecting slot width 1.1: inner arcuate slot width 1.0.

Apart from the formation of the polyester filaments having the particular configuration according to my invention, the various steps in the manufacture of the filaments, including preparation of the polymer, and the processing of the filaments, their conversion into staple fiber, and the handling of the fiberfill, including its conversion into batts or other forms and its use as filling material in the preparation of articles such as pillows and other filled articles, such as cushions, or formation into quilts, including quilted articles, including garments, may be carried out according to known procedures, as described in the prior art referred to herein and elsewhere. As explained, poly(ethylene terephthalate) is generally preferred as the polyester polymer, on account of its commercial availability and cost, and a relative viscosity will be selected appropriately in conjunction with processing conditions, to provide the desired configuration that is the essence of the present invention. A chain-brancher may be used, as described, e.g. in copending Applications Ser. Nos. 07/586,314 and 07/602,342, filed respectively, Sept. 21, 1990 and Oct. 23, 1990 by Broaddus et al. Corresponding to published EPA2 0 294 912.

As indicated, it has long been considered important, and has preferably been commercially practiced, to "slicken" polyester fiberfill by use, e.g., of polysiloxane slickening agents, as taught, for example, by Hoffman U.S. Pat. No. 3,271,189, Mead et al in U.S. Pat. No. 3,454,422, Ryan U.S. Pat. No. 3,488,217, Salamon et al., U.S. Pat. No. 4,146,674, and Takemoto Oil & Fat Co., Ltd., Japanese Published Patent Application 58-214,585 (1983). Polysiloxane and/or other slickening agents are used to improve the aesthetics of polyester fiberfill, and use of such slickener is preferred for some purposes according to the present invention. Non-silicone slickeners, e.g. as disclosed by Marcus, U.S. Pat. No. 4,818,599 issued April 4, 1989, and in copending U.S. application Ser. No. 04/435,513, filed by Halling and Marcus, by Jan. 9, 1990, corresponding to International Publication may prove advantageous for some purposes. Slickeners are preferably "cured", e.g. by heating, onto the filaments, so as to improve their durability, for most purposes.

Batts, pillows and other filled articles may be made by conventional methods such as are disclosed in the literature, which is referred to herein. Such processes include those, e.g. from U.S. Pat. Nos. 3,510,888, (Le Van), 3,772,137, (Tolliver), 4,129,675, (Scott) and copending application Ser. No. 07/110,692, filed Oct. 26, 1987 (Le Van) U.S. Pat. No. 4,869,771 and these references are hereby incorporated by reference. Also, the fiberfill can be used, if suitably prepared, according to the teachings of Marcus in U.S. Pat. Nos 4,618,531 and 4,783,364, and Snyder et al in copending application Ser. No. 07/508,878 (DP-4690), filed Apr. 12, 1990.

Fiberfill (in the form of staple) is generally converted into batting, usually on a garnetting machine. Typically, a Hunter Model 80 (James Hunter Machine Co., North Adams, MA.) with twin doffers and an in-line lapper may be used, the upper and lower webs being combined and then crosslapped on an apron moving at right angles to the direction of the web delivery from the garnett such that four to twelve layers are formed. The batting weight is controlled by adjusting the fiber feed rate to the garnett and the number of crosslapped layers, with 3 to 15 oz. per sq. yard being typical. The batting is then made into various useful fiberfill articles, such as (but not limited to) pillows, comforters, insulated apparel, sleeping bags, and furniture.

For pillow manufacturing, the batting is slit in-line to 22 in. widths for standard pillows (or 26 or 32 in. for queen or king sizes, respectively) and a sufficient length is rolled to weigh 20 oz. (or 25 or 31 oz. for queen and king sizes, respectively). The rolled lengths of batting are compressed and inserted into a 20×26 in. ticking (20×30 or 20×36 in. for queen or king sizes, respectively) using a stuffing apparatus, such as 30 that described by LeVan in U.S. Pat. No. 3,510,888, and are closed by stitching the open end.

For furniture uses, battings slit to 24 in. are unrolled, and 22 in. square segments are cut and stacked in layers vertically to form a 32 oz. cushion, which is then inserted into a 22×22×4 in. muslin ticking using a stuffing apparatus such as was described by LeVan in U.S. Pat. No. 3,510,888. The cushion is then inserted into a second ticking with an upholstery fabric.

Alternatively, the garnetting operation can be omitted and the fiberfill processed through an opener and blown directly into the ticking. These latter pillows are useful for back pillows for sofas.

When the battings are to be used for sleeping bags or comforters, the crosslapped battings are made to the correct size directly on the garnetting machine. Typically, the batting is crosslapped to 90 in. width and 8 oz. per square yard, then cut to 84 in. length. These battings are inserted into ticking or shell fabrics, usually polyester/cotton for comforters, and nylon taffeta for sleeping bags, and quilted in channels or decorative patterns. For extra insulation, a second or third layer of batting may be used, and non-woven scrims may be inserted between layers or between the battings and the ticking. For sleeping bags the quilted batting is folded, and the bottom and one side are provided with zippers. For apparel insulation, battings similar to those used for sleeping bags are quilted, and the garment is cut and sewn. Different weight battings may be used for the body and the arms to provide more insulation for the body and allow more freedom of movement in the arms.

In this regard, reference may be made to the following Examples, which further illustrate my invention. Reference may be made to the foregoing prior art, e.g., for discussion of conventional procedures, and for test procedures, such as for Bulk measurements (TBRM) in Tolliver, U.S. Pat. No. 3,772,137, and to International Publication No. WO89/08737 for friction measurements.

EXAMPLE 1

Filaments are spun from poly(ethylene terephthalate) of relative viscosity of 20.4 (as measured at 25° C. for 80 mg of polymer in 10 ml of hexafluoroisopropanol containing 100 ppm of sulfuric acid) at a polymer temperature of 291°–297° C. at 900 mpm (823 mpm) through a spinneret with 288 capillaries with a throughput per capillary of 0.306 lb./hr. (0.139 kg./hr.), using orifices as shown in FIG. 2. The filaments are grouped together to form a rope (of 914,000 relaxed drawn denier). The rope is drawn in a conventional manner, using a draw ratio of 3.46X in a hot, wet spray draw zone maintained at 90° C. The drawn filaments are crimped in a conventional stuffer box crimper of a cantilever type (3.5 in., 8.9 cm. size) and the crimped rope is relaxed in an oven at 180° C. A slickening finish containing a polyaminosiloxane is applied to the filaments to give about 0.32% (silicon) by weight on the fiber, then a conventional antistatic overlay finish of about 0.07% by weight is applied. The fibers are cut in a conventional manner to a length of 3.0 in. (75 mm.). The fibers are found to have an average total void content of about 12.3% and a denier per filament of about 9. The fibers have a cross section as shown in FIG. 1, containing seven continuous voids which are parallel, and substantially equal in size, six being substantially equi-spaced around the seventh which forms the center of the fiber. The periphery of the fiber is round and smooth.

A sample (C) of similar denier is made similarly, except that it contains four parallel continuous voids with a solid axial core, and with an average total void content of 17.7%, and is crimped to about the same Support Bulk (bulk at 0.2 psi) as the 7-hole fiber, for comparative purposes.

Various properties of the 7-hole Example (1) and of the 4-hole comparison (C) are measured, and are set out in Table A. It will be noted that, despite the higher degree of crimp used on the 7-hole fiber to obtain a similar Support Bulk, the F-F friction (coefficient of fiber-to-fiber friction) is lower, i.e., better, and that the bulk at 0.001 psi (Initial Bulk) is higher, indicating a softer product. These results are both surprising, and provide useful advantages in practice.

TABLE A

| Item | Crimp Per Inch | TBRM Bulk (in) .001 psi | TBRM Bulk (in) .2 psi | F—F Friction |
|---|---|---|---|---|
| (1) 7-hole | 4.8 | 6.25 | 0.43 | 0.203 |
| (C) 4-hole | 4.5 | 5.98 | 0.45 | 0.219 |

When both these types of fiberfill were processed into 20 oz. rolled batting pillows with similar heights, the 7-hole fiber pillow subjectively felt softer and more desirable, which is consistent with the results referred to above. The 7-hole fiber seemed to give a slower recovery from compression, that is very desirable, as it is more similar to the behavior of down filling in a pillow.

The durability of the fiberfill of the invention is compared with that of a 1-hole (with an essentially circular central void) and a 4-hole fiber in the following Example 2.

EXAMPLE 2

Three types of fibers having 1-hole, 4-hole and 7-hole cross-sections, respectively, were prepared essentially as described in Example 1, except that they were spun through spinnerets having 363, 388 and 325 capillaries, respectively, and were as follows, from poly(ethylene terephthalate) of RV 21. The void contents of the filaments, as spun, were 20.4%, 18.7%, and 19.1%, respectively. The deniers of the filaments, as spun, were all 14.7–14.8 dpf, and the relaxed drawn deniers were all 5.5 dpf. The drawing was conventional drawing in a hot, wet spray zone maintained at 95° C. An aminosilicone slickening finish was applied in amount 0.5% silicon, by weight on fiber. The drawn slickened tows were all crimped conventionally in a half inch stuffer box crimper to several different crimp frequencies from 4.5 to 10 crimps per inch then relaxed by heating at 170° C. for 10 minutes, then padded with 0.07% by weight of an antistatic finish, and cut to 3 inch staple, which was processed on a laboratory garnett into batts and into 20 oz. rolled batting standard-sized bed pillows. The height of each pillow was measured before and after being stomped individually for 2 hours in a programmed laboratory pillow stomper. The heights were measured on an Instron machine after the pillow had been fluffed (or refluffed) and had stood overnight. The 7-hole fiberfill consistently gave better durability, i.e., lost less height after stomping, as shown by averaged height losses of 12.7% (1-hole), 1.2% (4-hole) and 10.0% (7-hole), respectively, which are significant differences. The products were often rather different, with different properties and characteristics, so straight-forward comparisons were not always available between all three fibers, but three soft pillows (from fibers at equivalent crimp frequencies of about 5 crimps per inch) lost heights of 16.7%, 10.7% and 3.7% respectively, after stomping.

I believe that the better durability may correspond to a better crimp take-up (sometimes referred to as crimp index) that I noted generally for the 7-hole fibers of the invention (measured on unslickened fibers), and I believe this improved crimp take-up corresponds to better performance in fiberfill.

EXAMPLE 3

Five different 7-hole crimped staple fibers (items 1–5) were prepared under the conditions set out in Table B, being crimped so as to provide the TBRM bulk values (in inches, measured at 0.001 psi and at 0.2 psi, as for Table A) set out in Table B, with the indicated friction (F—F) measurements also indicated therein, but otherwise essentially as described in Example 2, with the specific deniers (DPF), throughputs (Tp, in pounds per hour (pph) per capillary), speeds (Spd, in ypm) and draw ratios (DR) as given in Table B.

TABLE B

| Item # | Tp pph | Spd ypm | DR | DPF | TBRM .001 | TBRM .2 | F—F |
|---|---|---|---|---|---|---|---|
| 1 | 85 | 1500 | 3.07 | 5.48 | 5.65 | .44 | .196 |
| 2 | 85 | 1500 | 3.07 | 5.45 | 5.43 | .54 | .264 |
| 3 | 85 | 1500 | 3.07 | 5.41 | 4.98 | .69 | .319 |
| 4 | 100 | 1200 | 3.39 | 7.02 | 5.40 | .54 | .248 |
| 5 | 100 | 900 | 3.53 | 9.09 | 5.21 | .53 | .269 |

These five different crimped staple fibers were all separately converted into battings on a garnett with an in-line crosslapper at weights of 4.8, 6.4 and 8 oz/sq yd. The resulting battings were cut to several rectangles, measuring 90×84 in., and the rectangles were inserted into 2 oz./sq. yd. nylon taffeta sleeves with layers of 0.4 oz./sq yd. REEMAY® scrim on each side of the battings, between them and the sleeves. Each assembly was quilted to provide 7 in channels, and was cut to provide a finished 84×72 in. quilted batting. The quilted battings were folded, and zippers sewn on the bottom and the long side, to produce rectangular sleeping bags with 1.4, 1.9, and 2.4 pounds of filling, depending on the weight of batting used, as indicated in Table C, which gives the weights (in pounds) for both the fiberfill fillings only (Fill Wt.) and for the total bags (Bag Wt.). The following comparisons were made on these bags, and the results are also given in Table C. The bags were compared for their loft by measuring their initial heights (in inches, with an Instron machine on pieces cut from a bag). Similarly the heights were measured after washing (one home laundering cycle). The bags were also compared for stuffability (indicated as "Stuf", being the force in pounds required to compress the bag into a cylinder until its height gives a density of 6 pounds/cu ft). From the composite data on loft and its durability after washing, and stuffability, the 7-hole hollow bag at 5.5 dpf (item #1) had the most preferred performance.

TABLE C

| Item # | TBRM .001 | TBRM .2 | F—F | Fill Wt. lbs | Bag Wt. lbs | Bag Hts Init | Bag Hts wash | Stuf lbs. |
|---|---|---|---|---|---|---|---|---|
| 1 | 5.65 | .44 | .196 | 1.4 | 3.91 | 1.86 | 1.56 | 58 |
| | | | | 1.9 | 4.57 | 2.24 | 2.04 | 62 |
| | | | | 2.4 | 5.49 | 2.64 | 2.55 | 73 |
| 2 | 5.43 | .54 | .264 | 1.4 | 3.93 | 1.80 | 1.45 | 66 |
| | | | | 1.9 | 4.68 | 2.41 | 2.03 | 72 |
| | | | | 2.4 | 5.64 | 3.07 | 2.74 | 77 |
| 3 | 4.98 | .69 | .319 | 1.4 | 3.82 | 1.62 | 1.32 | 75 |
| | | | | 1.9 | 4.69 | 2.18 | 1.85 | 80 |
| | | | | 2.4 | 5.46 | 2.67 | 2.25 | 90 |
| 4 | 5.40 | .54 | .248 | 1.4 | 3.91 | 1.66 | 1.51 | 69 |
| | | | | 1.9 | 4.63 | 2.16 | 2.08 | 72 |
| | | | | 2.4 | 5.47 | 2.77 | 2.48 | 76 |
| 5 | 5.21 | .53 | .269 | 1.4 | 3.92 | 1.67 | 1.48 | 69 |
| | | | | 1.9 | 4.69 | 2.13 | 1.92 | 73 |
| | | | | 2.4 | 5.64 | 2.68 | 2.30 | 77 |

Compared to the same commercial 5.5 dpf 4-hole item C, item #1 had 2–3% higher loft new and 3–5% higher loft after laundering, and a 8–10% advantage in stuffability, as can be seen from Table D.

TABLE D

| Item # | TBRM .001 | TBRM .2 | F—F | Fill Wt. lbs | Bag Wt. lbs | Bag Hts Init | Bag Hts wash | Stuf lbs. |
|---|---|---|---|---|---|---|---|---|
| 1 | 5.65 | .44 | .196 | 1.4 | 3.91 | 1.86 | 1.56 | 58 |
| | | | | 1.9 | 4.57 | 2.24 | 2.04 | 62 |
| | | | | 2.4 | 5.49 | 2.64 | 2.55 | 73 |
| C | 5.86 | .45 | .230 | 1.4 | 3.87 | 1.69 | 1.52 | 69 |
| | | | | 1.9 | 4.71 | 2.34 | 2.06 | 78 |
| | | | | 2.4 | 5.65 | 3.00 | 2.54 | 82 |

We claim:

1. A polyester fiberfill batt, being of crimped polyester fiber that is of denier per filament about 5 to about 20, and of essentially round peripheral cross-section, with at least continuous voids of essentially circular cross-section 7 along the length of the filaments, one such void being located essentially centrally, while the remaining voids are of essentially the same size as each other and are essentially equally spaced around the central void and from the central void and from the periphery of the filament.

2. A polyester fiberfill batt, being of crimped polyester fiber that is of denier per filament about 5 to about 20, and of essentially round peripheral cross-section, with at least continuous voids of essentially circular cross-section along the length of the filaments, one such void being located essentially centrally, while the remaining voids are of essentially the same size as each other and are essentially equally spaced around the central void and from the central void and from the periphery of the filament, and wherein the void content of the fiber is about 8 to about 25%.

3. A batt or article according to claim 2, wherein the fiberfill is slickened with a durable slickener.

4. A batt according to claim 3, wherein the crimp frequency of the fiber is about 4 to about 12 crimps/inch.

5. A batt according to claim 2, wherein the crimp frequency of the fiber is about 4 to about 12 crimps/inch.

6. A polyester fiberfill batt, being of slickened crimped polyester fiber that is of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament, and wherein the fiber is slickened with a durable slickener.

7. A polyester fiberfill batt, being of crimped polyester fiber that is of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament, and wherein the crimp frequency of the fiber is about 4 to about 12 crimps/inch.

8. A batt according to claim 7, wherein the fiberfill is slickened with a durable slickener.

9. A polyester fiberfill batt, being of crimped polyester staple fiber from about half an inch to about four inches in length, of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament.

10. A batt according to claim 9, wherein the fiberfill is slickened with a durable slickener.

11. A batt according to claim 9, wherein the void content of the fiber is about 8 to about 25%.

12. A batt according to claim 9, wherein the crimp frequency of the fiber is about 4 to about 12 crimps/inch.

13. A batt according to claim 12, wherein the fiberfill is slickened with a durable slickener.

14. A batt according to claim 13, wherein the void content of the fiber is about 8 to about 25%.

15. A batt according to any one of claims 1 to 14, wherein said crimped polyester fiber is provided with 7 such voids all of essentially the same size and essentially equally spaced from adjacent voids.

16. A furnishing or apparel article filled with a batt of polyester fiberfill, being of crimped polyester fiber that is a denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament.

17. A furnishing or apparel article filled with a batt of polyester fiber fill, being of crimped polyester fiber that is of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the peripheral of the filament, and wherein the void content of the fiber is about 8 to about 25%.

18. An article according to claim 17, wherein the fiber fill is slickened with a durable slickener.

19. An article according to claim 18, wherein the crimp frequency of the fiber is about 4 to about 12 crimps/inch.

20. An article according to claim 17, wherein the crimp frequency of the fiber is about 4 to about 12 crimps/inch.

21. A furnishing or apparel article filled with a batt of polyester fiber fill, being of slickened crimped polyester fiber that is of denier per filament about 5 to about 20, and of essentially round peripheral cross-section, with at least 7 continuous voids of essentially circular cross-section along the length of the filaments, one such remaining voids are of essentially the same size as each other and are essentially equally spaced around the central void and from the central void and from the periphery of the filament, and wherein the fiber is slickened with a durable slickener.

22. A furnishing or apparel article filled with a batt of polyester fiberfill, being of crimped polyester fiber that is of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament, and wherein the crimp frequency of the fiber is about 4 to about 12 crimps/inch.

23. An article according to claim 22, wherein the fiberfill is slickened with a durable slickener.

24. A furnishing or apparel article filled with a batt of polyester fiberfill, being of crimped polyester staple fiber from about half an inch to about four inches in length, of denier per filament about 5 to about 20, and of essentially around peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament.

25. An article according to claim 24, wherein the fiberfill is slickened with a durable slickener.

26. An article according to claim 24, where the void content of the fiber is about 8 to about 25%.

27. An article according to claim 24, wherein the crimp frequency of the fiber is about 4 to about 12 crimps/inch.

28. An article according to claim 27, wherein the fiberfill is slickened with a durable slickener.

29. An article according to claim 28, wherein the void content of the fiber is about 8 to about 25%.

30. An article according to any one of claims 18 to 31, wherein said crimped polyester fiber is provided with 7 such voids all of essentially the same size and essentially equally spaced from adjacent voids.

31. A furnishing or apparel article filled with opened polyester fiber fill, being of crimped polyester fiber that is of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament.

32. A furnishing or apparel article filled with opened polyester fiber fill, being of crimped polyester fiber that is of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament, and wherein the void content of the fiber is about 8 to about 25%.

33. An article according to claim 32, wherein the fiberfill is slickened with a durable slickener.

34. An article according to claim 32, wherein the crimp frequency of the fiber is about 4 to about 12 crimps/inch.

35. An article according to claim 32, wherein the crimp frequency of the fiber is about 4 to about 12 crimps/inch.

36. A furnishing or apparel article filled with opened polyester fiberfill, being of slickened crimped polyester fiber that is of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament, and wherein the fiber is slickened with a durable slickener.

37. A furnishing or apparel article filled with opened polyester fiberfill, being of crimped polyester fiber that is of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament, and wherein the crimp frequency of the fiber is about 4 to about 12 crimps/inch.

38. An article according to claim 37, wherein the fiber fill is slickened with a durable slickener.

39. A furnishing or apparel article filled with opened polyester fiberfill, being of crimped polyester staple fiber from about half an inch to about four inches in length, of denier per filament about 5 to about 20, and of essentially round peripheral cross-section, with at least 7 continuous voids of essentially circular cross-section along the length of the filaments, one such void being located essentially centrally, while the remaining voids are of essentially the same size as each other and are essentially equally spaced around the central void and from the central void and from the periphery of the filament.

40. An article according to claim 39, wherein the fiberfill is slickened with a durable slickener.

41. An article according to claim 39, wherein the void content of the fiber is about 8 to about 25%.

42. An article according to claim 37, wherein the crimp frequency of the fiber is about 4 to about 12 crimps/inch.

43. An article according to claim 42, wherein the fiberfill is slickened with a durable slickener.

44. An article according to claim 43, wherein the void content of the fiber is about 8 to about 25%.

45. An article according to any one of claim 31 to 44, wherein said crimped polyester fiber is provided with 7 such voids all of essentially the same size and essentially equally spaced from adjacent voids.

46. A filled article according to claim 47, that is a pillow.

47. A filled article according to claim 23, that is a pillow.

48. A filled article according to any one of claims 16 to 29 or 31 to 44, that is a pillow.

* * * * *